US006183277B1

(12) United States Patent
Okabe et al.

(10) Patent No.: US 6,183,277 B1
(45) Date of Patent: Feb. 6, 2001

(54) LEVER FITTING-TYPE CONNECTOR

(75) Inventors: Toshiaki Okabe; Tetsuya Yamashita, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/389,585

(22) Filed: Sep. 3, 1999

(30) Foreign Application Priority Data

Sep. 10, 1998 (JP) ..... 10-257028

(51) Int. Cl.[7] ..... H01R 13/62
(52) U.S. Cl. ..... 439/157; 439/372
(58) Field of Search ..... 439/157, 372, 439/160, 152

(56) References Cited

U.S. PATENT DOCUMENTS 5,957,710 * 9/1999 Nagano ..... 439/157
6,019,620 * 2/2000 Kodama et al. ..... 439/157

FOREIGN PATENT DOCUMENTS 6-275337 9/1994 (JP) .
10-247551 9/1998 (JP) .

* cited by examiner

*Primary Examiner*—Paula Bradley
*Assistant Examiner*—Tho D. Ta
(74) *Attorney, Agent, or Firm*—Sughrue, Mion, Zinn, Macpeak & Seas, PLLC

(57) ABSTRACT

A lever 22 is pivotally supported on a male connector 21 by bosses 27, and provisionally-retaining abutment piece portions 38 are formed respectively at lower portions of side walls 28 of the lever 22 at a rear end portion thereof. Provisionally-retaining blocks 37 are formed at a lower portion of the male connector 21 at a rear end portion thereof, and the provisionally-retaining abutment piece portions 38 are abutted respectively against the provisionally-retaining blocks 37 in an initially-fitted condition. Cancellation plates 39 for canceling the abutting engagement of the provisionally-retaining abutment piece portions 38 with the provisionally-retaining blocks 37 are formed within a hood portion 32 of a female connector 23. With this construction, when the male connector 21 is to be fitted into the hood portion 32, engagement projections 30 can be easily inserted into guide grooves 34, respectively. Only the provisionally-retaining abutment piece portions 38 need to have resiliency, and therefore it is not necessary to increase the wall thickness of the lever 22, and also the pivotal movement of the lever 22 can be easily effected.

12 Claims, 7 Drawing Sheets

LEVER FITTING-TYPE CONNECTOR

BACKGROUND OF INVENTION

1. Field of the Invention

This invention relates to a lever fitting-type connector in which a connector is fitted into a mating connector by pivotally moving a lever mounted on the connector.

2. Related Art

Unexamined Japanese Patent Publication Hei. 6-275337 discloses one known conventional lever fitting-type connector. As shown in FIG. 7, this lever fitting-type connector comprises a female connector 1, a fitting-disconnecting lever 2 pivotally mounted on the female connector 1 by pivot shafts 6, and a male connector 3 for fitting into the female connector 1.

Driven pins 4 are formed on opposite side surfaces of the male connector 3, respectively. Pin guide notches 5 for respectively receiving the driven pins 4 are formed in opposite side walls of the female connector 1 . Drive cam grooves 7 are formed in the lever 2, and a side plate 2*a* extends across an open end portion of each of the drive cam grooves 7, that is, extends from one side edge of the drive cam groove 7 to the other side edge thereof, and a lower end portion 2*b* of the side plate 2 is held against the other side edge of the drive cam groove 7. In this construction, when the driven pins 4 on the male connector 3 are fitted into the lever 2 while expanding it, the lower end portion 2*b* of each side plate 2*a* is disengaged from the edge of the associated drive cam groove 7, so that the lever 2 can be pivotally moved. In accordance with the pivotal movement of the lever 2, the male connector 3 is connected to the female connector 1.

In the above conventional lever fitting-type connector, however, the thickness of the whole of the lever 2, including the side plates 2*a*, need to be increased in order to prevent the lower end portion 2*b* of each side plate 2*a* from being disengaged from the edge of the associated drive cam groove 7, and another requirement, contradictory to the above requirement, is that the side plates 2*a* of the lever 2 can be easily flexed (elastically deformed) in order to reduce an inserting force required for inserting the male connector 3, and the conventional lever fitting-type connector could not satisfied the two requirements.

SUMMARY OF INVENTION

It is an object of this invention to provide a lever fitting-type connector in which an initially-fitted condition of a lever can be maintained without increasing the thickness of the lever, and besides the lever can be easily pivotally moved.

The above object has been achieved by a lever fitting-type connector of the present invention wherein a lever is pivotally supported on a connector at a portion thereof intermediate opposite ends of the lever, and by pressing an operating portion, formed at one end portion of the lever, with this pivotally-supporting portion used as an application point, the lever is pivotally moved, thereby fitting the connector into a mating connector; provided in that the lever has provisionally-retaining abutment piece portions which have resiliency, and are held in abutting engagement with the connector in an initial condition; and the mating connector has cancellation portions for canceling the abutting engagement of the provisionally-retaining abutment piece portions with the connector in accordance with the fitting of the connector.

In the present invention, in the initial condition before the connector is fitted into the mating connector, the provisionally-retaining abutment piece portions are abutted against the connector, and therefore the pivotal movement of the lever in the operating direction is prevented. Therefore, in this initial condition, when the connector is to be fitted into the mating connector, the connector and the lever can be inserted in proper postures into the mating connector. And besides, the abutting engagement of the provisionally-retaining abutment piece portions is canceled by the cancellation portions of the mating connector as the connector is fitted into the mating connector, and therefore the lever can be pivotally moved in the operating direction midway through the fitting operation, and therefore the lever can be properly pivotally moved, so that the positive fitting operation can be carried out. The provisionally-retaining abutment piece portion has resiliency, and therefore the whole of the lever does not need to be flexed, and it is not necessary to increase the rigidity of the lever and the wall thickness thereof.

In the lever fitting-type connector of the present invention, the provisionally-retaining abutment piece portions are formed integrally with the lever, and are disposed beneath the operating portion, and each of the cancellation portions comprises a cancellation plate formed integrally on an inner surface of the mating connector.

In this invention, in addition to the effects, the cancellation plates, formed on the inner surface of the mating connector, cancel the abutting engagement of the provisionally-retaining abutment piece portions with the connector, and therefore in accordance with the fitting of the connector into the mating connector, the lever is automatically brought into a condition in which the lever can be operated.

In the lever fitting-type connector of the invention, the connector has provisionally-retaining blocks for abutting engagement with the provisionally-retaining abutment piece portions, respectively.

Therefore, in the present invention, in addition to the effects, the provisionally-retaining blocks, formed on the connector, need only to abut respectively against the provisionally-retaining abutment piece portions, and therefore a large space is not required, and the connector is prevented from being formed into a large size.

In the lever fitting-type connector of the invention, recesses for respectively receiving the provisionally-retaining abutment piece portions are formed in the inner surface of the mating connector.

In the present invention, when the abutting engagement of the provisionally-retaining abutment piece portions is canceled by the cancellation portions, the provisionally-retaining abutment piece portions are received respectively in the recesses, and therefore the provisionally-retaining abutment piece portions will not prevent the pivotal movement of the lever.

In the lever fitting-type connector of the present invention, each of the provisionally-retaining abutment piece portions has a tapering surface which is brought into sliding contact with the associated cancellation plate in accordance with the fitting of the connector.

In the present invention, the cancellation plate is brought into sliding contact with the tapering surface of the provisionally-retaining abutment piece portion, and this enables the provisionally-retaining piece portion to be smoothly disengaged from the abutment portion of the connector. Therefore, the shaking of the connector is prevented during the connector-fitting operation, and the lever can be operated smoothly.

DETAILED DESCRIPTION OF PREFERRED EMBODIMENTS

Figure 1:
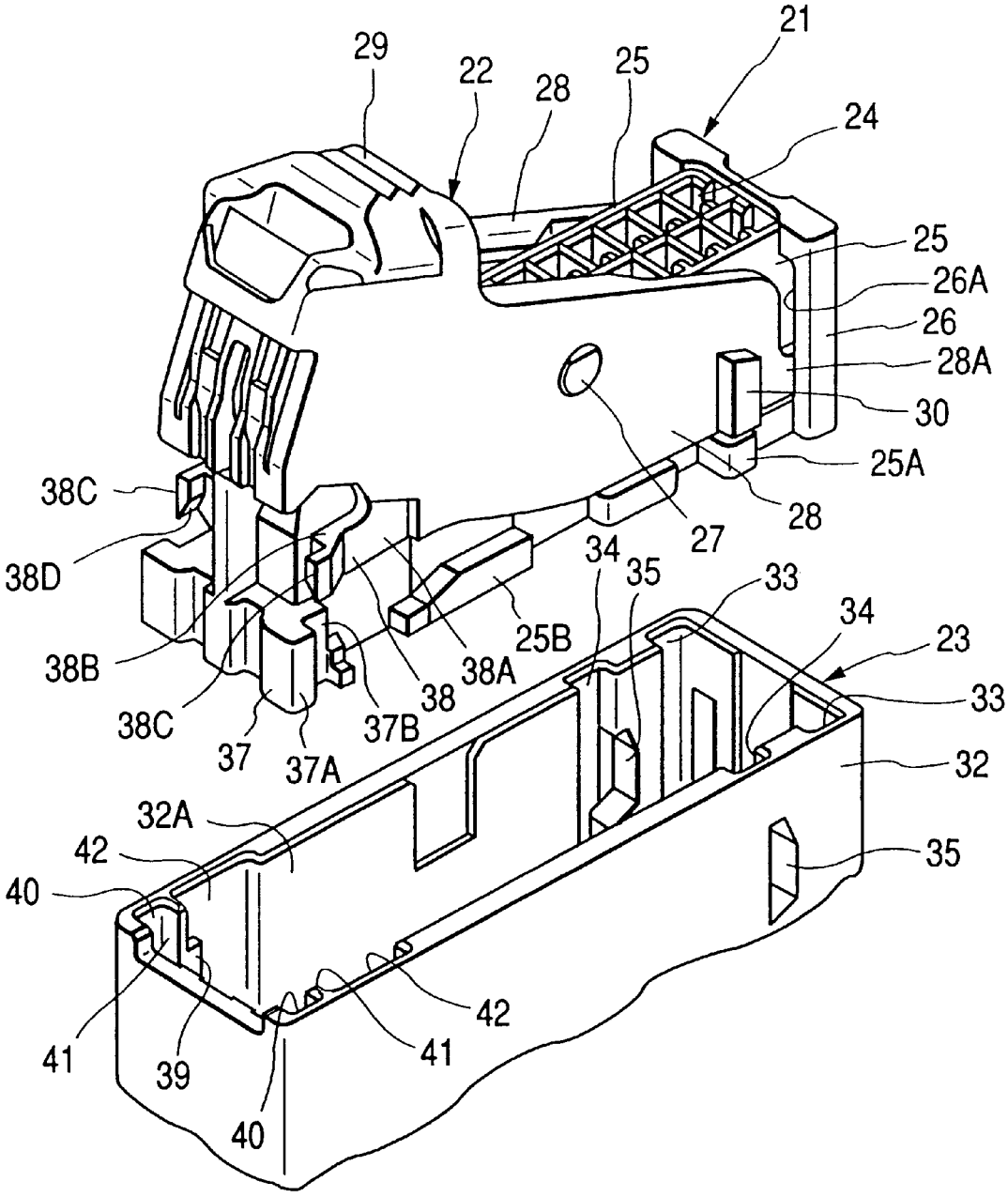
FIG. 1 is a perspective view of a preferred embodiment of a lever fitting-type connector of the present invention, showing a condition before connectors are fitted together.

One preferred embodiment of a lever fitting-type connector of the present invention will now be described in detail with reference to the drawings. FIGS. 1 to 6 show the lever fitting-type connector of this embodiment.

This lever fitting-type connector comprises a male connector 21, a lever 22 pivotally mounted on this male connector 21, and a female connector 23 into which the male connector 21 is fitted.

The male connector 21 includes a plurality of terminal receiving chambers 24 extending therethrough in an upward-downward direction, and terminals are received respectively in these terminal receiving chambers, and connection terminals in the female connector 23 are inserted into the male connector from the lower side, and are connected respectively to the terminals in the male connector. A pair of disengagement prevention ribs 26 are respectively formed on and project laterally from opposite side surfaces 25 of the male connector 21 at their one ends, these ribs 26 extending in a connector-fitting direction. Bosses 27, serving as rotation shafts, are formed on and projected from the opposite side surfaces 25 of the male connector 21, respectively, and the lever 22 is pivotally supported by the bosses 27. Guide projections 25A are formed respectively on lower portions of the opposite side surfaces 25 of the male connector 21, and are disposed adjacent to the disengagement prevention ribs 26, respectively. The lever 22 is abutted against the guide projections 25A in its initial condition, and the guide projections 25A are guided toward the female connector 23 in the fitting direction. Stopper blocks 25B for stopping the operation of the lever 22 are formed respectively on the lower portions of the opposite side surfaces 25 of the male connector 21 intermediate the opposite ends of the male connector (rather near to the rear end thereof), and these stopper blocks 25B project laterally respectively from the opposite side surfaces 25 by a distance generally equal to a wall thickness of the lever 22. Provisionally-retaining blocks 37 and 37 for limiting the pivotal movement of the lever 22 in its initial condition in an operating direction (counterclockwise direction in FIG. 1) are formed respectively on the lower portions of the opposite side surfaces 25 of the male connector 21 at the rear end thereof.

The lever 22 includes a pair of right and left side walls 28, and an operating portion 29 interconnecting the right and left side walls 28 at upper edges of rear end portions thereof. The bosses 27 of the male connector 21 are inserted respectively in holes formed respectively through the right and left walls 28, so that the lever 22 can be pivotally moved about the bosses 27. Projected portions 28A are formed respectively on front ends of the side walls 28 remote from the operating portion 29, and these projected portions 28A are inserted respectively in slots 26A for movement therealong, which slots 26A are formed respectively in the disengagement prevention ribs 26 of the male connector 21, and extend in the fitting direction. An engagement projection 30 of a generally rectangular parallelepiped shape is formed on and projects laterally from a lower portion of each of the side walls 28, and is disposed between the projected portion 28A and the boss 27. These engagement projections 30 serve as a supporting point when fitting the male connector 21 into the female connector 23 upon pivotal movement of the lever. In the initial condition of the lever 22, the engagement projections 30 are disposed in registry with the guide projections 25A, respectively.

Provisionally-retaining abutment piece portions 38 are formed integrally with lower portions of the rear ends of the two side walls 28 of the lever 22, respectively, and these piece portions 38 abut respectively against the provisionally-retaining blocks 37, formed on the male connector 21, to limit the pivotal movement of the lever 22 in the operating direction.

Here, the provisionally-retaining blocks 37 and the provisionally-retaining abutment piece portions 38 will be described.

The provisionally-retaining block 37 includes a laterally-projecting guide projection 37A, and an abutment block 37B of a predetermined thickness formed on and extending along the side surface of the male connector 21. The provisionally-retaining abutment piece portion 38 includes an elastic, resilient arm plate portion 38A of a small thickness extending rearwardly from the lower portion of the side wall 28 of the lever 22, an abutment portion 38B formed integrally at a rear end of the arm plate portion 38A for abutment against an upper surface of the associated abutment block 37B, and a cancellation piece portion 38C extending rearwardly from an outer surface of the abutment portion 38B. The cancellation piece portion 38C has a tapering surface 38D formed on an inner surface thereof at a lower end thereof, and this taper surface 38D can be brought into sliding contact with a cancellation plate 39 (described later) on the female connector 23. When the lever 22 is held in the initial condition, the abutment portion 38B rests on the abutment block 37B, and hence is held in abutting engagement with the abutment block 37B.

The female connector 23 has a hood portion 32 with an open top into which the male connector 21 is fitted. Elongate grooves 33 for respectively receiving the disengagement prevention ribs 26 of the male connector 21 are formed respectively in inner side surfaces 32A of the hood portion 32 at a front end portion thereof, and extend in the fitting direction (upward-downward direction). Guide grooves 34, corresponding respectively to the guide projections 25A formed respectively on the opposite side surfaces 25 of the male connector 21, are formed respectively in the inner side surfaces 32A of the hood portion 32, and extend in the fitting direction. An engagement hole 35 is formed in one side edge of the guide groove 34 intermediate opposite ends thereof, and projects forwardly from the guide groove 34, the engagement hole 35 having an inner surface which can engage the engagement projection 30 of the lever 22, and serves as a supporting point. The engagement holes 35 are formed through the opposite side walls of the hood portion 32, respectively, and therefore the condition of engagement of the engagement projection 30 in the engagement hole 35 can be confirmed from the outside.

Figure 2:
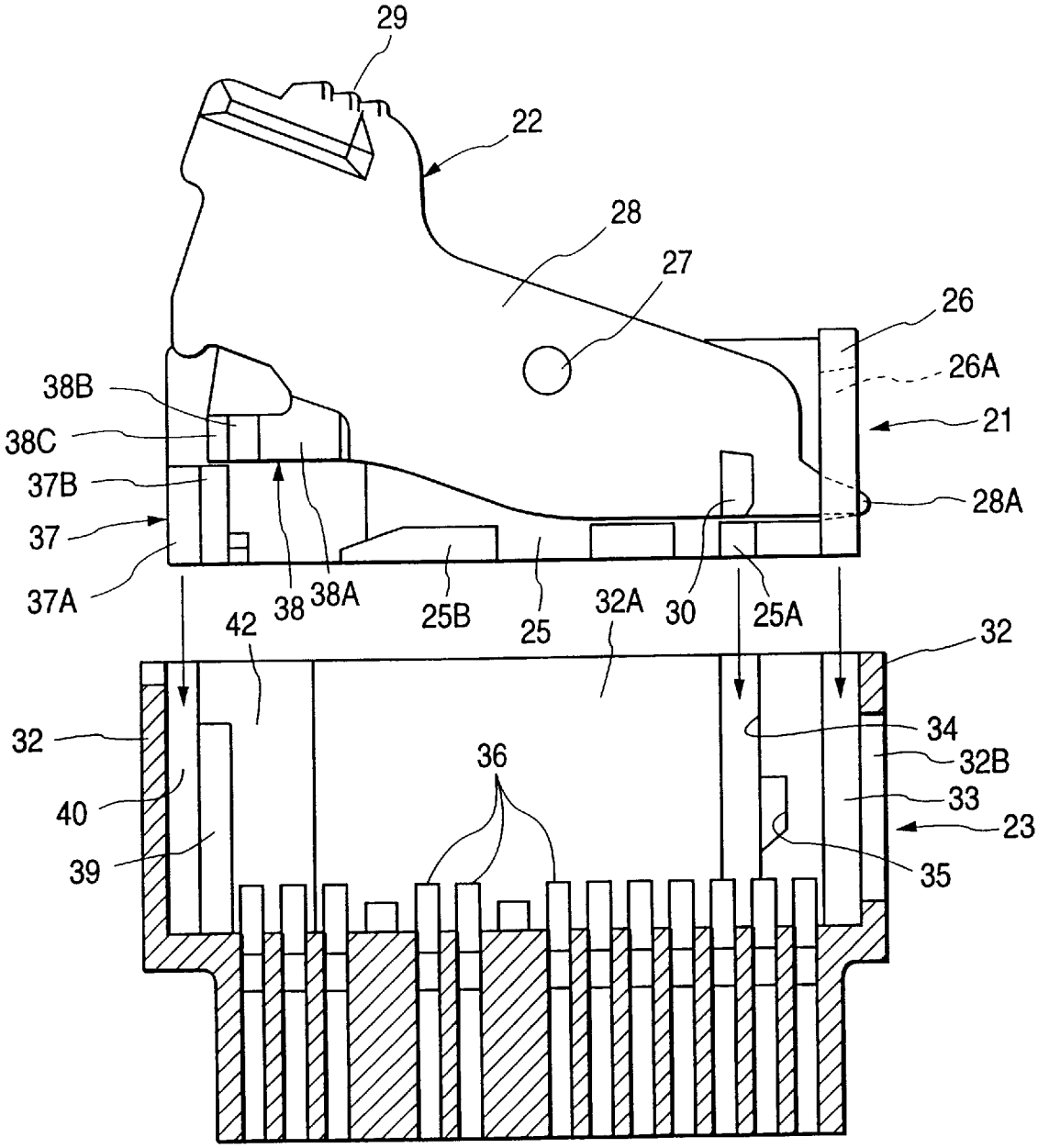
FIG. 2 is a partially cross-sectional, side-elevational view of the above embodiment, showing a condition before the connectors are fitted together.

Block guide grooves 40 for respectively guiding the guide projections 37A (formed on the male connector 21) in the fitting direction are formed respectively in the inner side surfaces 32A of the hood portion 32 at a rear end portion thereof. Cancellation piece portion-receiving grooves 42 of a predetermined width for respectively receiving the cancellation piece portions 38C are formed adjacent to those sides of the guide grooves 40 close to the front end of the female connector. The cancellation piece portion-receiving groove 42 is separated from the corresponding guide groove 40 by a partition wall 41 extending inwardly from the inner side surface of the hood portion 32. The cancellation plate 39 is formed integrally with the partition wall 41, and is spaced a predetermined distance from the upper end of the partition wall 41, and extends to the bottom of the hood portion 32, the cancellation plate 39 being spaced a predetermined distance from the bottom of the corresponding cancellation piece portion-receiving groove 42 in parallel relation thereto. Namely, the cancellation plate 39, the partition wall 41 and the bottom of the cancellation piece portion-receiving groove 42 jointly form a space for receiving the cancellation piece portion 38C flexed outwardly by the upper end of the cancellation plate 39. As shown in FIG. 2, the plurality of connection terminals 36 project upwardly from an inner bottom surface of the hood portion 32. A pair of slots 32B are formed through a front end wall of the hood portion 32, and the projected portions 28A of the lever 22, when projected respectively from the disengagement prevention ribs 26, are received respectively in these slots 32B.

The construction of the lever fitting-type connector of this embodiment has been described above, and next, the operation and effects thereof will be described.

Figure 3:
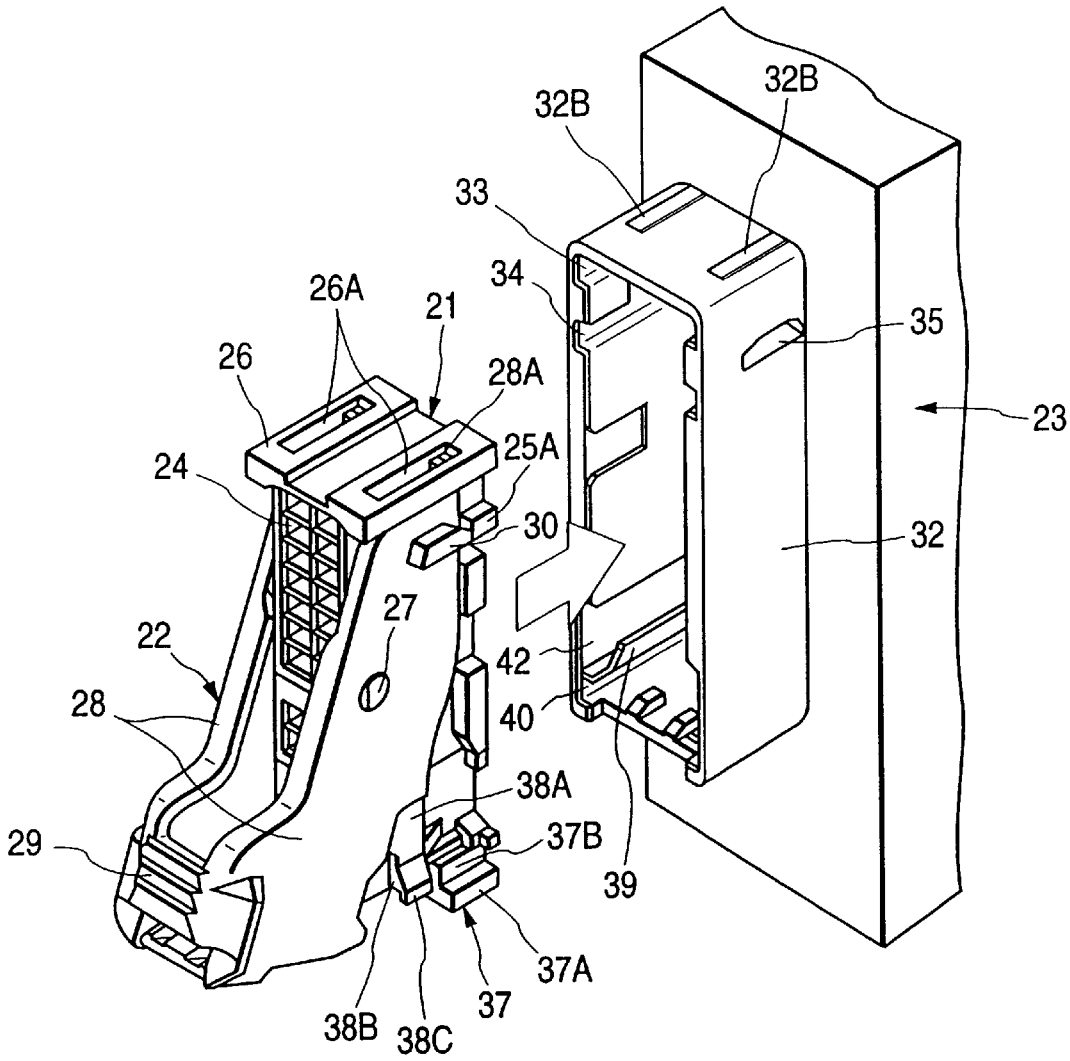
FIG. 3 is a perspective view of the above embodiment, showing a condition before the connectors are fitted together.
Figure 4:
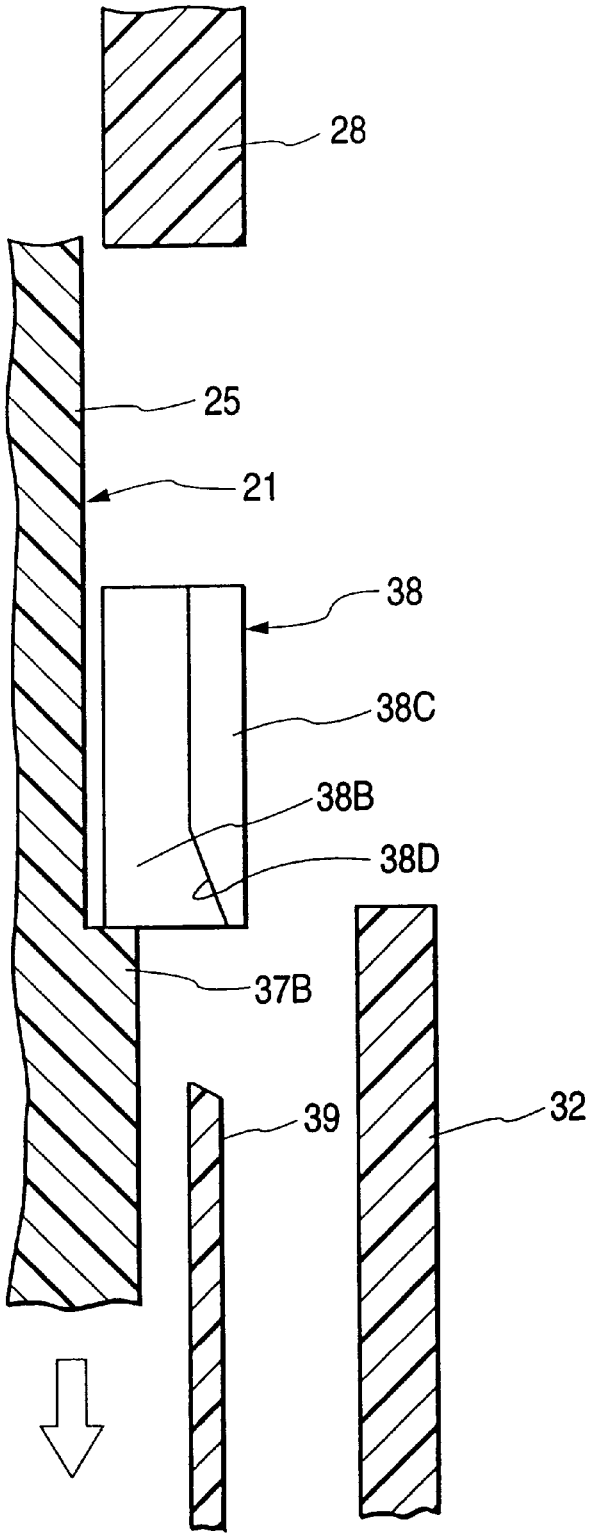
FIG. 4 is an enlarged view of an important portion of the above embodiment.

FIGS. 1 to 3 show a condition before the male connector 21 is fitted into the hood portion 32 of the female connector 23. In this condition, the abutment portions 38B of the lever 22 rest respectively on the abutment blocks 37B of the male connector 21, thereby preventing the pivotal movement of the lever 22 in the fitting operating direction (counterclockwise direction in FIG. 1). When the male connector 21 is moved in a direction of a thick arrow (FIG. 4) by effecting the fitting operation of the male connector 21, the cancellation plates 39 approach the cancellation piece portions 38*c*, respectively.

Figure 5:
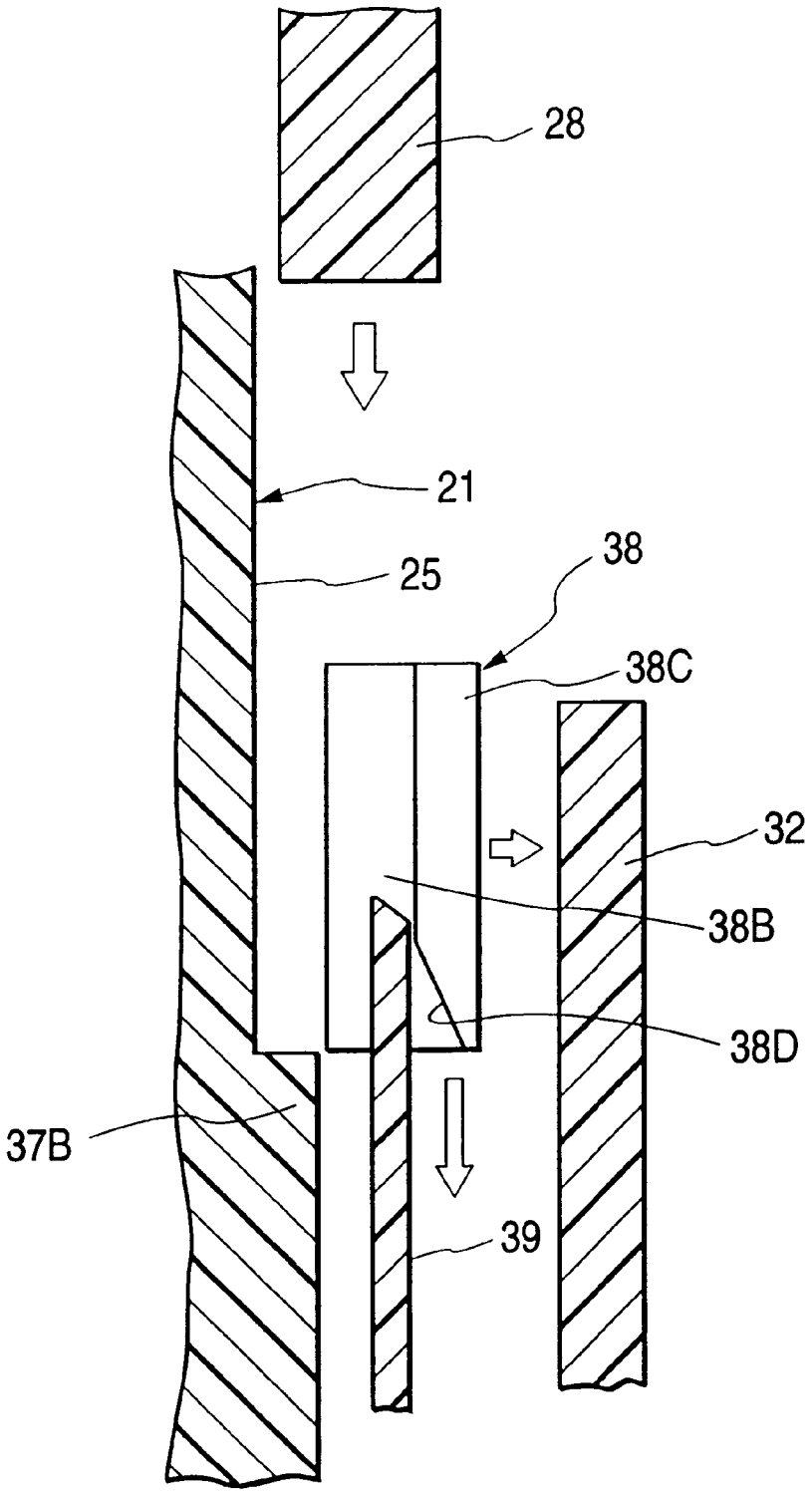
FIG. 5 is an enlarged view of the important portion of the above embodiment.
Figure 6:
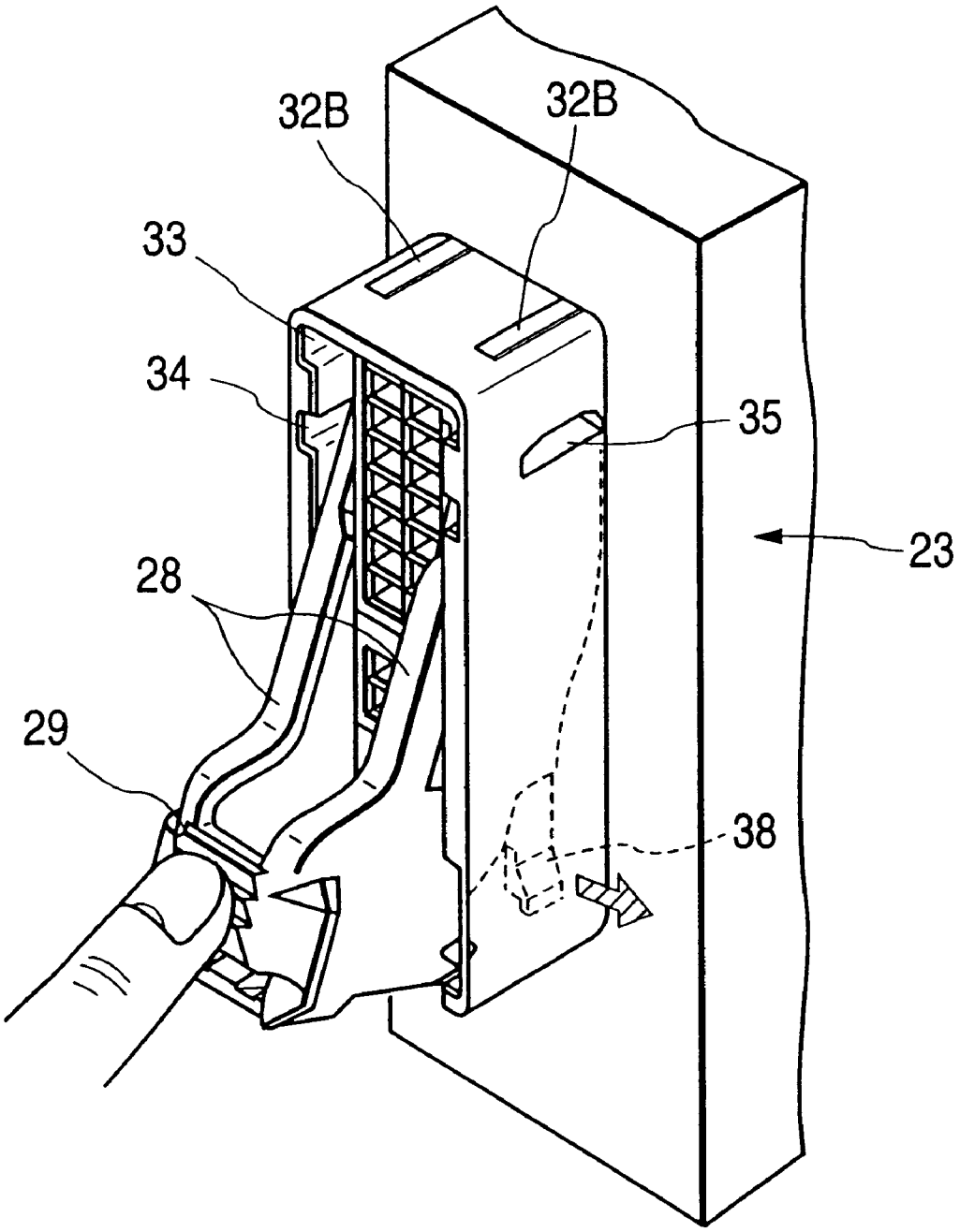
FIG. 6 is a perspective view of the above embodiment, showing a fitted condition.
Figure 7:
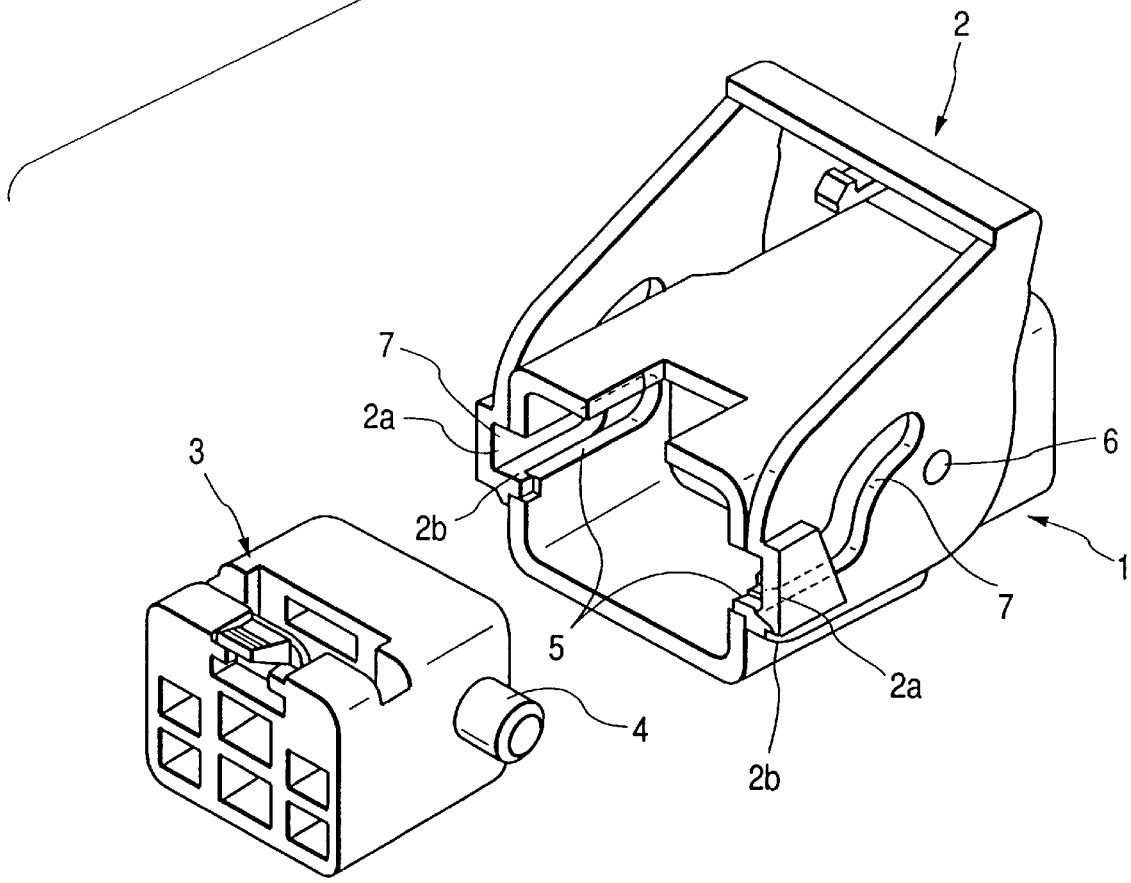
FIG. 7 PRIOR ART
FIG. 7 is a perspective view of a conventional lever fitting-type connector.

Then, as shown in FIG. 2, the disengagement prevention ribs 26 are inserted respectively into the elongate grooves 33, and the guide projections 25A, as well as the engagement projections 30, are inserted respectively into the guide grooves 34, and the guide projections 37A are inserted respectively into the block guide grooves 40. These inserting operations are effected simultaneously, so that the male connector 21 is fitted into the hood portion 32. As this fitting operation proceeds, each cancellation plate 39 is brought into sliding contact with the tapering surface 38D of the associated cancellation piece portion 38C to flex the cancellation piece portion 38C outwardly, as shown in FIG. 5. As a result, each abutment portion 38B of the lever 22 is disengaged from the associated abutment block 37B of the male connector 21, thereby allowing the pivotal movement of the lever 22 in the operating direction. Then, the male connector 21 can be fitted into the hood portion 32 by pressing the operating portion 29 by the finger, as shown in FIG. 6.

At the lower portion of the front end portion of the male connector 21, the engagement projections 30 are engaged respectively in the engagement holes 35, and serve as the supporting point for the pivotal movement of the lever 22, and also the bosses 27 serve as an application point, and therefore the male connector 21 is inserted into the hood portion 32, so that the male terminals in the female connector 23 can be connected respectively to the female connectors in the male connector 21.

The preferred embodiment has been described above, but the present invention is not limited to this embodiment, and various design changes, related to the subject matter of the invention, can be made.

As is clear from the above description, in the present invention , in the initial condition, when the connector is to be fitted into the mating connector, the connector and the lever can be inserted in proper postures into the mating connector. And besides, the abutting engagement of the abutment piece portions is canceled by the cancellation portions of the mating connector as the connector is fitted into the mating connector, and therefore the lever can be pivotally moved in the operating direction midway through the fitting operation, and therefore the lever can be properly pivotally moved, so that the positive connector-fitting operation can be carried out. The abutment piece portion has resiliency, and therefore the whole of the lever does not need to be flexed, and it is not necessary to increase the rigidity of the lever and the wall thickness thereof, and the large-size design and the high-cost design can be prevented.

In the present invention, in addition to the effects, the cancellation plates, formed on the inner surface of the mating connector, cancel the abutting engagement of the abutment piece portions with the connector, and therefore in accordance with the fitting of the connector into the mating connector, the lever is automatically brought into a condition in which the lever can be operated. Therefore, an undue force is not required for pivotally moving the lever, and the lever can be smoothly operated.

In the present invention, in addition to the effects, the provisionally-retaining blocks, formed on the connector, need only to abut respectively against the abutment piece portions, and therefore a large space is not required, and the connector is prevented from being formed into a large size.

In the present invention, in addition to the effects, when the abutting engagement of the abutment piece portions is canceled by the cancellation portions, the abutment piece portions are received respectively in the recesses, and therefore the abutment piece portions will not prevent the pivotal movement of the lever.

In the present invention, the shaking of the connector is prevented during the connector-fitting operation, and the lever can be operated smoothly.

What is claimed is:

1. A lever fitting-type connector comprising:

a first connector mateable with a second connector;

a lever pivotally supported on said first connector at an intermediate portion thereof intermediate opposite ends of said lever, said lever including an operating portion formed at one end portion of said lever and an engagement portion provided at an opposite end portion of lever with said intermediate portion being disposed between said operating portion and said engagement portion, said engagement portion engaging said second connector, said lever being pivotally moved by pushing said operating portion with said intermediate portion serving as an application point to fit said first connector into said second connector, said lever including:

provisionally-retaining abutment piece portions provided at said one end portion of said lever and beneath said operating portion, which have resiliency and are held in abutting engagement with said first connector in an initial condition; and cancellation portions, provided with said second connector, for canceling the abutting engagement of said provisionally-retaining abutment piece portions with said connector in accordance with the fitting of said first connector with said second connector.

2. A lever fitting-type connector according to claim 1, wherein said mating connector includes recesses for respectively receiving said provisionally-retaining abutment piece portions in the inner surface of said mating connector.

3. A lever fitting-type connector according to claim 1, in which said provisionally-retaining abutment piece portions are formed integrally with said lever, and each of said cancellation portions includes a cancellation plate formed integrally on an inner surface of said mating connector.

4. A lever fitting-type connector according to claim 3, wherein each of said provisionally-retaining abutment piece portions has a tapering surface which is brought into sliding contact with the associated cancellation plate in accordance with the fitting of said connector.

5. A lever fitting-type connector according to claim 1, wherein said connector has provisionally-retaining blocks for abutting engagement with said provisionally-retaining abutment piece portions, respectively.

6. A lever fitting-type connector according to claim 5, wherein said mating connector includes recesses for respectively receiving said provisionally-retaining abutment piece portions in the inner surface of said mating connector.

7. A lever fitting-type connector according to claim 3, wherein said connector has provisionally-retaining blocks for abutting engagement with said provisionally-retaining abutment piece portions, respectively.

8. A lever fitting-type connector according to claim 7, wherein each of said provisionally-retaining abutment piece portions has a tapering surface which is brought into sliding contact with the associated cancellation plate in accordance with the fitting of said connector.

9. A lever fitting-type connector according to claim 3, wherein said mating connector includes recesses for respectively receiving said provisionally-retaining abutment piece portions in the inner surface of said mating connector.

10. A lever fitting-type connector according to claim 9, wherein each of said provisionally-retaining abutment piece portions has a tapering surface which is brought into sliding contact with the associated cancellation plate in accordance with the fitting of said connector.

11. A lever fitting-type connector according to claim 7, wherein said mating connector includes recesses for respectively receiving said provisionally-retaining abutment piece portions in the inner surface of said mating connector.

12. A lever fitting-type connector according to claim 11, wherein each of said provisionally-retaining abutment piece portions has a tapering surface which is brought into sliding contact with the associated cancellation plate in accordance with the fitting of said connector.

* * * * *